United States Patent [19]

Miyamoto

[11] Patent Number: 4,576,867

[45] Date of Patent: Mar. 18, 1986

[54] INK JET RECORDING PAPER

[75] Inventor: Shigehiko Miyamoto, Kamagaya, Japan

[73] Assignee: Mitsubishi Paper Mills, Ltd., Tokyo, Japan

[21] Appl. No.: 686,928

[22] Filed: Dec. 27, 1984

[51] Int. Cl.[4] ..... B41M 5/00

[52] U.S. Cl. ..... 428/342; 346/135.1; 427/261; 428/211; 428/411.1; 428/537.5

[58] Field of Search ..... 346/1.1, 135.1; 400/126; 427/261, 288; 428/195, 206, 207, 211, 342, 411.1, 500, 511, 537.5, 323, 329–331

[56] References Cited

U.S. PATENT DOCUMENTS 4,371,582 2/1983 Sugiyama et al. ..... 428/341

*Primary Examiner*—Bruce H. Hess

*Attorney, Agent, or Firm*—Cushman, Darby & Cushman

[57] ABSTRACT

By attaching a cationic resin having a structure represented by the following general formula (I) to at least the surface of an ink jet recording paper, the water-resistance and the sunlight fastness of the image formed on said ink jet recording paper can be improved:

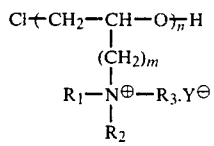

(I)

wherein $R_1$, $R_2$ and $R_3$ represent alkyl group; m represents a number of 1 to 7; n represents a number of 2 to 20; and Y represents an acid residue.

16 Claims, No Drawings

INK JET RECORDING PAPER

BACKGROUND OF THE INVENTION

1. FIELD OF THE INVENTION

The present invention relates to an ink jet recording paper.

2. DESCRIPTION OF THE PRIOR ART

Recently, ink jet recording process is rapidly extending in various fields such as hard-copying devices for figures including Chinese characters, and color images, because it has various excellent characteristic advantages such as high copying speed, low noise, easiness to produce multi-color image, applicability to a wide variety of record patterns and unnecessity of development and fixation. Furthermore, application of ink jet recording process to multi-color printing and color photographic printing is also being attempted, because the color image produced by the ink jet recording process is not inferior to the color images produced by usual multi-color printing process and the cost of ink jet recording process is lower than that of conventional printing processes using printing plate or printing master sheet when only a small number of prints are to be made.

Plain papers and coated papers used in the usual printings and the so-called baryta paper used as a base for photographic printing paper are very low in the absorbability of ink. Accordingly, if they are used in the ink jet recording process, the ink remains on the surface of paper for a long period of time, and the remaining ink will stain the image if parts of recording device touches the ink, and if the operator touches the ink or the printed surface is rubbed by the continuously discharged sheet. Further, if ink droplets of 2–4 colors are superposed at one position in high density images or multi-color records, the large quantity of inks remaining unabsorbed mix themselves together or the inks flow out of the position. Thus, these papers are practically unusable for the ink jet recording process.

The paper for use in the ink jet recording process must give an image of high color density and clear color tone. In addition, it must rapidly absorb the ink and must be free from the flow-out of ink and from the danger of stain even if the paper is touched just after printing. In addition, the diffusion of ink dot to the lateral direction on the recording sheet must be prevented in order to give an image free from blurring and having a high resolution. The paper for ink jet recording process must satisfy all these requirements simultaneously.

Hitherto, various proposals have been made with the aim of solving these problems. For example, there is mentioned in Japanese Patent Kokai (Laid-Open) No. 53,012/77 an ink jet recording paper prepared by wetting a low-sizing base paper with a coating material for surface treatment. In Japanese Patent Kokai (Laid-Open) No. 49,113/78, there is disclosed an ink jet recording paper prepared by impregnating a sheet internally containing powdery urea-formaldehyde resin with a water-soluble polymer. In Japanese Patent Kokai (Laid-Open) No. 5,830/80, there is disclosed an ink jet recording paper prepared by providing an ink-absorbing layer coated on the surface of a support. In Japanese Patent Kokai (Laid-Open) No. 51,583/80, there is disclosed a case in which a non-colloidal substance is used as the pigment in coated layer. In Japanese Patent Kokai (Laid-Open) No. 146,786/80, there is disclosed an ink jet recording paper having a water-soluble polymer-coated layer. Further, in Japanese Patent Kokai (Laid-Open) No. 11,829/80, there is disclosed a method for controlling the spreading of ink dot and speed of ink absorption by using a structure having 2 or more layers in which the ink-absorbability of the uppermost layer is adjusted to 1.5–5.5 mm/minute and that of the second layer is adjusted to 5.5–60.0 mm/minute.

However, in the technical ideas represented by Japanese Patent Kokai (Laid-Open) No. 58,012/77, it is intended to enhance the degree of resolution by sacrificing the ink-absorbability to some extent. On the other hand, the technical ideas represented by Japanese Patent Kokai (Laid-Open) No. 49,113/78 have a defect that the ink is diffused deeply into the paper layer so that the ink cannot produce a high color density, even though considerably high ink-absorbability and resolution can be reached. Thus, both the techniques are unsatisfactory as multi-color ink jet recording paper.

As a method for overcoming the above-mentioned defects, an ink jet recording paper coated with non-colloidal silica powder has been disclosed in Japanese Patent Kokai (Laid-Open) No. 51,583/80 and OMR (optical mark reader) papers such as bar code printing paper, coated with finely powdered silicic acid, have been disclosed in Japanese Patent Publication No. 790/78.

Although resolution, color property, color density, absorbability, roundness of printed dot image and the like can be greatly improved by providing a surface layer of synthetic silica or other white-colored fine powder as above, such papers are still unsatisfactory when used as a poster exposed outdoors or a photograph to be stored for a long period of time, because many of the inks applied to these papers are water-soluble so that the ink will dissolve out again if the image formed thereon is contacted with water.

In order to solve this problem, a variety of proposals have been made hitherto. For example, in Japanese Patent Kokai (Laid-Open) No. 53,591/80, there is disclosed a recording paper in which a water-soluble metal salt is attached to the recording surface. In Japanese Patent Kokai (Laid-Open) No. 84,992/81, there is disclosed an ink jet recording process which comprises printing images on a recording medium containing a polycationic polyelectrolyte in its surface with an aqueous ink containing a water-soluble direct dye or acid dye. In Japanese Patent Kokai (Laid-Open) No. 150,396/80, there is disclosed a method for enhancing the water-resistance of an ink jet record which comprises, after an ink jet recording by the use of an aqueous ink, treating the record with a waterproofing agent capable of forming a lake with the dye in the aqueous ink. In Japanese Patent Kokai (Laid-Open) No. 58,869/81, there is disclosed a method for enhancing the water-resistance of ink jet recording sheet which comprises, after making an ink jet record with an aqueous ink on an ink jet recording sheet coated with a water-soluble polymer, treating the sheet with a waterproofing agent capable of insolubilizing the water-soluble polymer.

Sometimes, various cation resins are used as the waterproofing agent for the image produced from aqueous ink, and as the cation resin, mordants such as dicyandiamide condensate, polyamines, polyethyleneimine and the like have been used. However, if the mordant is used in so large an amount as to obtain a sufficient water-resistance, the white-colored paper can yellow in the air or upon irradiation by sunlight or, even if the yellowing of white-colored paper does not take place, the sunlight-fastness (sunlight-stability) of the dye constituting the image is deteriorated. Thus, it has been quite difficult to fulfil both the requirements concerning water-resistance and weather-stability (resistance to yellowing of sheet and light stability of image).

SUMMARY OF THE INVENTION

The present inventors have conducted elaborated studies on waterproofing agents with the aim of obtaining an ink jet recording paper improved in water-resistance and sunlight fastness (sunlight stability) of aqueous ink image. As the result, it has been found that the water-resistance and sunlight fastness of an ink image formed on an ink jet recording paper can be improved by attaching a cationic resin having a structure represented by the following general formula (I):

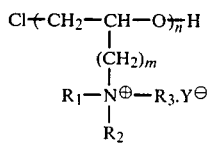

(I)

wherein $R_1$, $R_2$ and $R_3$ represent alkyl group; m represents a number of 1 to 7, n represents a number of 2 to 20, and Y represents an acid residue, to at least the surface of said ink jet recording paper. Based on this finding, the present invention has been accomplished.

DETAILED DESCRIPTION OF THE INVENTION

According to the present invention, if a cationic resin represented by the above-mentioned general formula (I) is attached to at least the surface of an ink jet recording paper and this recording paper is used for ink jet recording using an aqueous ink containing a direct dye or an acid dye having anionic dissociative group, the dye in the aqueous ink and the cationic resin in the recording paper are combined together, and thereby the dissolution of the dye is prevented.

Among the cationic resins represented by general formula (I), the following resins are most preferably usable in the invention:

(Ia) : Compounds of general formula (I) wherein $R_1$, $R_2$ and $R_3$ are all methyl group, m is 1 to 3, and n is 5 to 15.

(Ib) : Compounds of general formula (I) wherein $R_1$, $R_2$ and $R_3$ are all methyl group, m is 1 to 3, and n is 2 to 10.

Among the compounds (Ia), the followings are particularly preferable:

(Ia-1): Compounds (Ia) wherein m is 1 to 2, and n is 7 to 13, and particularly m is 1 and Y is Cl.

Among the compounds (Ib), the following is most preferable:

(Ib-1): Compound (Ib) wherein m is 1 and Y is Cl.

The following commercial products belong to the most preferable members of the cationic resin of formula (I) of the invention:

Nalpoly-607 (manufactured by Nalco Chemical Co.),
Polyfix-601 (manufactured by Showa Kobunshi K.K.), etc.

The water-resistance and weather-stability of the image can be improved by attaching usually 0.1 to 4 $g/m^2$ and preferably 0.2 to 2 $g/m^2$ of the cationic resin represented by general formula (I) to the base paper. In applying the cationic resin to the base paper, an aqueous solution of the cationic resin or an aqueous solution composed mainly of the cationic resin and a conventional water-soluble binder such as oxidized starch, polyvinyl alcohol, CMC or other water-soluble celloulose derivatives is coated on a base paper by means of size press, roll coater or other coaters. Alternatively, an aqueous solution of the cationic resin is coated on the surface of the so-called coated paper having on its surface a coating layer composed of a pigment having a high ink-absorbing ability such as synthetic silica, synthetic alumina, calcium carbonate or the like and such a water-soluble binder as mentioned above by means of air-knife coater, roll coater, blade coater, spray or the like. Alternatively, the cationic resin is directly added to an aqueous solution composed of the above-mentioned pigment having a high ink-absorbing ability and a water-soluble binder, and with the resulting coating color, a coated layer is formed.

As used in the invention, the term "attaching a cationic resin to at least the surface of ink jet recording paper" means attaching the cationic resin only to the surface of ink jet recording paper as well as not only attaching the cationic resin to the surface of ink jet recording paper but also incorporating the cationic resin into the inner part of the recording paper, inclusively.

On the other hand, the aqueous ink preferably used for making an ink jet record on the ink jet recording paper of the invention contains at least one member selected from water-soluble acid dyes and water-soluble direct dyes as a dye, and if desired it additionally contains wetting agent, dye-solubilizer, antiseptic, antibacterial agent and the like.

As said water-soluble direct dye, C.I. Direct Black, C.I. Direct Yellow, C.I. Direct Blue, C.I. Direct Red and the like can be used. As said water-soluble acid dye, C.I. Acid Black, C.I. Acid Yellow, C.I. Acid Blue, C.I. Acid Red, C.I. Acid Black and the like can be used. Of course, the dyes usable in the invention are not limited to the above-mentioned ones.

The above-mentioned dyes have a water-soluble nature owing to the existence of $-SO_3Na$ group, $-SO_3H$ group and $-NH_2$ group in their molecule. If such an ink is attached to the surface of the above-mentioned recording paper and allowed to be absorbed thereinto, the anionic groups of the dye present in the ink and the cationic resin adhering to the surface of the recording paper form an ionic bonding to produce a water-insoluble salt, whereby water-resistance of image is improved and sunlight fastness of image is prevented from deterioration.

Next, referring to the following examples, the invention will be illustrated in an non-limitative way. In the examples, all the parts and % are by weight.

In the first place, the methods for measuring the properties referred to in the examples will be mentioned.

(1) Water-resistance

An image was produced by the over-all printing of an ink (cyan (C), magenta (M), yellow (Y) and black (Bl). After naturally drying the image for one hour, it was dipped in water at 30° C. for 3 minutes. The color densities of the image before and after the dipping were measured by means of Macbeth densitometer, and the percentage of the color density after the dipping to the color density before the dipping was taken as a measure for water-resistance. A higher value of this percentage means a higher water-resistance.

(2) Light-stability

An image was produced by the over-all printing of an ink (C, M, Y, Bl). The image was irradiated in xenon fade-o-meter (FAL-25X-HCL, manufactured by Suga Shikenki K.K.) at 40° C., at a humidity of 60%, at an illumination of 63 W/m$^2$, for 40 hours, and the color density before and after the irradiation was measured by means of Macbeth densitometer RD 514. The percentage of color density after the irradiation to the color density before the irradiation was taken as a measure for light-stability. A higher value of this percentage means a higher light-stability.

(3) Background-yellowing property

A recording paper was allowed to stand indoors for one month at 20° C. at 65% RH, after which the extent of yellowing on the record surface was visually examined. The degree of yellowing was expressed by the following marks: X—Remarkable color change, Δ—A small extent of color change, O—A hardly noticeable color change.

EXAMPLE 1 and COMPARATIVE EXAMPLES 1 and 2

To a pulp slurry composed of 80 parts of LBKP having a freeness of 350 ml and 20 parts of NBKP having a freeness of 400 ml was added 25 parts of calcium carbonate PC (precipitated calcium carbonate manufactured by Shiraishi Kogyo-sha) as a filler, to which was then added 1 part of Cato F (cationized starch manufactured by Ohji National Co.) as a retention agent and a paper strength agent. From the mixture thus prepared, a base paper having a basis weight of 60 g/m$^2$ of a Fourdrinier paper machine. Then, by means of a size press, a size press solution containing 4% of MS 3800 (oxidized starch manufactured by Nippon Shokuhin Co.) as a water-soluble binder and 1% of a cationic resin having the following structural formula (II):

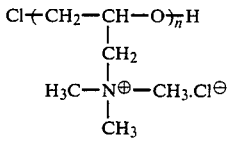

(II)

wherein n is 2 to 10 (Nalpoly 607, manufactured by Nalco Chemical Co.) was attached to the base paper in an amount of 3.2 g/m$^2$ as expressed by the weight of solid component. Subsequently, the sheet was dried to prepare a recording paper of Example 1.

For comparison, recording sheets of Comparative Example 1 and Comparative Example 2 were also prepared by repeating the above-mentioned procedure, except that the cationic resin used in Example 1 was replaced with polyethyleneimine (Epomin P 1000, manufactured by Nippon Shokubai Kagaku) and dicyandiamide-formaldehyde condensate (Sanfix 70, manufactured by Sanyo Kasei). These recording sheets were examined for water-resistance, light-stability and background-yellowing property to obtain the results shown in Table 1.

TABLE 1

| Recording paper | Background-yellowing | Properties: Water-resistance of printed image (%) M | C | Y | Bl | Light-stability of printed image (%) M | C | Y | Bl |
|---|---|---|---|---|---|---|---|---|---|
| Example | | 99 | 100 | 97 | 100 | 74 | 99 | 84 | 95 |
| Comparative Example 1 | X | 100 | 100 | 99 | 100 | 44 | 98 | 59 | 87 |
| Comparative Example 2 | | 100 | 100 | 99 | 100 | 13 | 91 | 15 | 71 |

It is apparent from Table 1 that the sheet of Example 1 is superior to the sheets of comparative examples in resistance to background-yellowing, water-resistance and light-stability.

EXAMPLE 2 AND COMPARATIVE EXAMPLES 3 TO 5

To a pulp slurry composed of 90 parts of LBKP having a freeness of 380 ml and 10 parts of NBKP having a freeness of 410 ml was added 10 parts of talc as a filler, to which were then added 0.3 part of rosin sizing agent and 2.2 parts of alumina. A paper was made from the mixture by means of a Fourdrinier paper machine. To the paper was then applied 2.8 g/m$^2$ (as expressed by solid component) of oxidized starch by means of a size press to prepare a coating base paper. Thus obtained coating base paper was coated with a coating color prepared by adding 13 parts of polyvinyl alcohol as a water-soluble binder and appropriate quantities of antifoaming agent, flow property modifier, antiseptic, hardening agent and the like to a slurry composed of 80 parts of synthetic silica and 20 parts of heavy calcium carbonate as pigments, so that the weight of coating layer came to 16 g/m$^2$, by means of an air-knife coater. Thus, a base coated paper was obtained. On the other hand, a coating color containing 3% of polyvinyl alcohol and 3% of the same cationic resin as used in Example 1 was prepared, and it was applied to the surface of the above-mentioned base coated paper by means of air-knife coater so that the weight of this second coating layer came to 2 g/m$^2$ as expressed by solid component, after which it was dried. Subsequently, the coated sheet was mildly super-calendered to obtain a double coated recording paper of Example 2.

For comparison, recording sheets of Comparative Examples 3, 4 and 5 were prepared by repeating the procedure of Example 2, except that the above-mentioned cationic resin used in combination with polyvinyl alcohol was replaced with Liquid LC-3 (styrene-monoalkyl maleate cationic copolymer, manufactured by Kindai Kagaku Kogyo), Nikawalock D 1000 (dicyandiamide condensate, manufactured by Nippon Carbide Co.) and Weistex T 101 (a resin expressed by the following formula, sold by Nagase Sangyo:

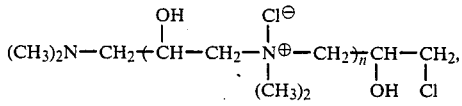

respectively. Those recording sheets were examined for water-resistance and weather-stability to obtain the results shown in Table 2.

TABLE 2

| Recording paper | Background-yellowing | Properties: Water-resistance of printed image % M | C | Y | Bl | Light-stability of printed image % M | C | Y | Bl |
|---|---|---|---|---|---|---|---|---|---|
| Example 2 | | 100 | 100 | 99 | 100 | 72 | 98 | 88 | 92 |
| Comparative Example 3 | | 58 | 100 | 25 | 100 | 70 | 98 | 86 | 98 |
| Comparative Example 4 | | 100 | 100 | 99 | 99 | 20 | 96 | 82 | 80 |
| Comparative Example 5 | | 99 | 100 | 100 | 100 | 59 | 100 | 30 | 87 |

It is apparent from Table 2 that the sheet of Comparative Example 3 is insufficient in water-resistance and the sheets of Comparative Examples 4 and 5 are inferior in light-stability, while the sheet of Example 2 is improved in both water-resistance and light-stability as compared with the comparative samples.

EXAMPLE 3

The procedure of Example 2 was repeated, except that the cationic resin Nalpoly 607 used in Example 2 was replaced with Polyfix 601 (manufactured by Showa Kobunshi Co., n =ca. 8 to 10).

The recording paper obtained in Example 3 was excellent in both water-resistance and light-stability, and was comparable to the recording paper obtained in Example 2 in these properties.

While in Example 1 the black printed image (Bl) turned reddish with time, the black printed image (Bl) of the present example (Example 3) did not turn reddish with time.

What is claimed is:

1. An ink jet recording paper, wherein a cationic resin having a structure represented by the following general formula (I):

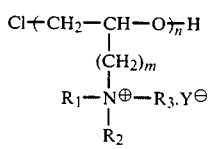

(I)

wherein $R_1$, $R_2$ and $R_3$ represent alkyl group, m represent a number of 1 to 7, n represents a number of 2 to 20, and Y represents an acid residue, is attached to at least the surface of said ink jet recording paper.

2. An ink jet recording paper according to claim 1, wherein said cationic resin is attached in an amount of 0.1 g/m$^2$ to 4 g/m$^2$.

3. An ink jet recording paper according to claim 2, wherein said cationic resin is attached in an amount of 0.2 g/m$^2$ to 2 g/m$^2$.

4. An ink jet recording paper according to claim 1, wherein said cationic resin is attached to its surface by applying an aqueous solution containing a cationic resin and a water-soluble binder to the surface of a base paper and drying the solution.

5. An ink jet recording paper according to claim 1, wherein said cationic resin is attached to its surface by applying an aqueous solution containing a cationic resin to the surface of the so-called coated paper on which a coating layer containing a pigment having a high ink-absorbing ability and a water-soluble binder is formed, and then drying the solutions.

6. An ink jet recording paper according to claim 1, wherein said cationic resin is attached to its surface by applying an aqueous solution containing a cationic resin, a pigment having a high ink-absorbing ability and a water-soluble binder to the surface of a base paper and then drying the aqueous solution.

7. An ink jet recording paper according to claim 5 or claim 6, wherein said pigment having a high ink absorbing ability is selected from the group consisting of synthetic silica, synthetic alumina and calcium carbonate.

8. An ink jet recording paper according to claim 4, 5 or 6, wherein said water-soluble binder is selected from the group consisting of oxidized starch, polyvinyl alcohol, CMC and other water-soluble cellulose derivatives.

9. An ink jet recording paper according to claim 1, wherein, in general formula (I), $R_1$, $R_2$ and $R_3$ are all methyl group, m is a number of 1 to 3, and n is a number of 5 to 15.

10. An ink jet recording paper according to claim 9, wherein, in general formula (I), m is a number of 1 to 2 and n is a number of 7 to 13.

11. An ink jet recording paper according to claim 10, wherein, in general formula (I), m is 1 and Y is Cl.

12. An ink jet recording paper according to claim 1, wherein, in general formula (I), $R_1$, $R_2$ and $R_3$ are all methyl group, m is a number of 1 to 3, and n is a number of 2 to 10.

13. An ink jet recording paper according to claim 12, wherein, in general formula (I), m is 1 and Y is Cl.

14. An ink jet recording paper according to claim 1 which is used for multi-color recording.

15. An ink jet recording paper according to claim 14, wherein said multi-color recording is carried out with inks of cyan (C), magenta (M), yellow (Y) and black (Bl).

16. An ink jet recording paper according to claim 1 which is used for the ink jet recording using an aqueous ink containing a water-soluble direct dye and/or a water-soluble acid dye.

* * * * *